US011503678B2

(12) United States Patent
Galindo Perez et al.

(10) Patent No.: US 11,503,678 B2
(45) Date of Patent: Nov. 15, 2022

(54) COOKING APPLIANCE DEVICE AND METHOD FOR OPERATING A COOKING APPLIANCE DEVICE

(71) Applicant: BSH Hausgeräte GmbH, Munich (DE)

(72) Inventors: Juan Jose Galindo Perez, Saragossa (ES); Jose Manuel Jorquera Cocera, Saragossa (ES); Sergio Llorente Gil, Saragossa (ES); Carlos Obon Abadia, Saragossa (ES); Jose Manuel Palacios Gasos, Saragossa (ES); Enrique Javier Perez Visa, Saragossa (ES); Edgar Jorge Ramirez Laboreo, Saragossa (ES); Fernando Sanz Serrano, Calamocha (ES)

(73) Assignee: BSH Hausgeräte GmbH, Munich (DE)

( * ) Notice: Subject to any disclaimer, the term of this patent is extended or adjusted under 35 U.S.C. 154(b) by 738 days.

(21) Appl. No.: 16/348,518

(22) PCT Filed: Dec. 12, 2017

(86) PCT No.: PCT/IB2017/057822
§ 371 (c)(1),
(2) Date: May 9, 2019

(87) PCT Pub. No.: WO2018/116061
PCT Pub. Date: Jun. 28, 2018

(65) Prior Publication Data

US 2022/0110192 A1 Apr. 7, 2022

(30) Foreign Application Priority Data

Dec. 23, 2016 (ES) ..... P201631666

(51) Int. Cl.
*H05B 6/12* (2006.01)

(52) U.S. Cl.
CPC ..... *H05B 6/129* (2013.01); *H05B 2206/022* (2013.01)

(58) Field of Classification Search
CPC ..... H05B 6/129; H05B 2206/022
See application file for complete search history.

(56) References Cited

U.S. PATENT DOCUMENTS

| | | | | |
|---|---|---|---|---|
| 4,455,319 A | 6/1984 | Clark | | |
| 4,675,507 A * | 6/1987 | Akiyoshi | F24C 7/06 | 126/275 E |
| 2010/0059513 A1* | 3/2010 | Farachi | H05B 6/129 | 219/756 |

FOREIGN PATENT DOCUMENTS

| | | |
|---|---|---|
| DE | 19852617 A1 | 1/2000 |
| DE | 19961781 A1 | 7/2001 |
| DE | 102012220775 A1 | 6/2013 |

OTHER PUBLICATIONS

International Search Report PCT/IB2017/057822 dated Mar. 16, 2018.

* cited by examiner

*Primary Examiner* — Dana Ross
*Assistant Examiner* — Kuangyue Chen
(74) *Attorney, Agent, or Firm* — Michael E. Tschupp; Andre Pallapies; Brandon G. Braun

(57) ABSTRACT

A cooking appliance device includes a heating unit having a heating element for heating a cooking chamber in a heating operating state, and a cooking chamber element configured to at least partially bound the cooking chamber. The cooking chamber element has a part region with a surface shape which changes in the heating operating state in response to a thermal expansion of the cooking chamber element. The heating unit includes an adapting element which is arranged at least in part on the cooking chamber element and has in (Continued)

facing relation to the part region a surface which adapts in the heating operating state to the surface shape of the part region.

20 Claims, 6 Drawing Sheets

COOKING APPLIANCE DEVICE AND METHOD FOR OPERATING A COOKING APPLIANCE DEVICE

CROSS-REFERENCES TO RELATED APPLICATIONS

This application is the U.S. National Stage of International Application No. PCT/IB2017/057822, filed Dec. 12, 2017, which designated the United States and has been published as International Publication No. WO 2018116061 A1 and which claims the priority of Spanish Patent Application, Serial No. P201631666, filed Dec. 23, 2016, pursuant to 35 U.S.C. 119(a)-(d).

BACKGROUND OF THE INVENTION

The invention proceeds from a cooking appliance device and from a method for operating a cooking appliance device.

Cooking appliances are known from the prior art, said cooking appliances having a heating unit comprising at least one heating element which, in a heating operating state, is provided for heating a cooking chamber, wherein in the heating operating state a cooking chamber element changes its surface shape by thermal expansion so that a spacing between the heating unit and the cooking chamber element varies. In this case, the change to the spacing results in reduced heating efficiency.

BRIEF SUMMARY OF THE INVENTION

The object of the invention, in particular, is to provide a generic cooking appliance device with improved properties with regard to efficiency. The object is achieved by the characterizing features of the invention.

The invention proceeds from a cooking appliance device having at least one heating unit having at least one heating element which, in at least one heating operating state, is provided for heating a cooking chamber, and having at least one cooking chamber element which at least partially bounds the cooking chamber and has at least one part region whose surface shape changes, in the heating operating state, by thermal expansion of the cooking chamber element.

It is proposed that the heating unit has at least one adapting element which is arranged at least in part on the cooking chamber element and is provided, at least in the heating operating state, to adapt to the, in particular changed, surface shape of the part region. In particular, in this case the adapting element is provided, in a non-heated operating state, to adapt at least one surface facing the part region to a first surface shape of the part region and in the heating operating state to adapt the surface facing the part region to a second surface shape of the part region. "Provided" is intended to be understood, in particular, as specifically designed and/or equipped. By an object being provided for a specific function is intended to be understood, in particular, that the object fulfills and/or performs this specific function in at least one use state and/or operating state.

"Cooking appliance device" is intended to be understood in this connection, in particular, as at least one part, in particular a subassembly, of a cooking appliance, in particular a hob, a grill appliance, a microwave and/or preferably an oven. Advantageously, the cooking appliance is configured in this case as an induction cooking appliance, in particular as an induction hob, as an induction grill appliance, as an induction microwave and/or particularly preferably as an induction oven. Additionally, the cooking appliance device comprises, in particular, at least one appliance housing which advantageously comprises the cooking chamber element, preferably a muffle wall, and in particular bounds and/or defines the cooking chamber and at least one appliance closure element which is provided to cover, in particular to close, the cooking chamber. "Heating unit" is intended to be understood in this connection, in particular, as a unit which, in particular, comprises at least one, advantageously just one, heating element which is preferably configured as a heating coil and, in particular, is provided for indirect and/or direct heating of at least one object, in particular the food to be cooked, cookware and/or cooking chamber element. Advantageously, the heating unit is arranged on the cooking chamber element and/or at least the part region of the cooking chamber element in a planar manner and, advantageously in the non-heated operating state, is arranged at least substantially parallel and spaced apart from the cooking chamber element and/or the part region of the cooking chamber element. Advantageously, the heating unit, in particular, is able to be detached mechanically from the cooking chamber element, in particular from the part region of the cooking chamber element, and is advantageously able to be replaced. In particular, the cooking appliance device may also comprise a plurality of heating units which are preferably at least substantially structurally the same, such as for example at least two, at least three and/or at least four heating units which are advantageously arranged on different cooking chamber elements, in particular muffle walls. Objects which are "at least substantially structurally the same" are intended to be understood, in particular, in this case as objects which have external shapes which are configured to be at least substantially identical to one another but, in particular, may differ from one another in at least one feature, advantageously an internal construction and/or a mode of operation. Preferably, the objects which are at least substantially structurally the same, however, are identical to one another apart from production tolerances and/or within the context of possible production technology and/or within the context of standardized tolerances. "At least substantially parallel" is intended to be understood, in particular, in this case as an orientation of a direction relative to a reference direction, in particular in one plane, wherein the direction has a deviation relative to the reference direction, in particular, of less than 8°, advantageously less than 5° and particularly advantageously less than 2°. Moreover, "adapting element" is intended to be understood, in particular, as an element which is advantageously operatively connected to the heating element and which is provided to adapt itself and/or an object, in particular the heating element, which is operatively connected to the adapting element, to a change in shape and/or deformation, in particular a curvature of the cooking chamber element and/or the part region of the cooking chamber element which is effected, in particular, by thermal expansion. In particular, the adapting element may be adapted to different curvatures of a cooking chamber element, in particular the part region of the cooking chamber element. In particular, a curvature of the cooking chamber element at a cooking chamber temperature of 500° C. in a direction perpendicular to the cooking chamber element may achieve a change in shape of at least 3 mm, advantageously of at least 5 mm and particularly preferably of at least 8 mm relative to a basic shape of the cooking chamber element at room temperature. Preferably, in this case the adapting element is connected at least partially non-positively and/or positively to the heating element. A "heating operating state" is intended to be understood, in particular, as an operating state which is provided for heating, cooking and/or keeping warm food which is located in the cooking chamber. In particular, in the heating operating state a current flows through the heating element at the same time. By this embodiment of the cooking appliance device, in particular, an efficiency, in particular a heating efficiency, an energy efficiency and/or a cost efficiency, may be improved. In particular, in this case a high heating efficiency may be achieved and power and/or energy costs may be reduced. Additionally, a more uniform heat distribution may be advantageously achieved in the cooking chamber. In this case, in particular, in the heating operating state an improved thermal transmission to the cooking chamber element, a more even heat distribution in the cooking chamber and/or a particularly low heat loss, in particular outside the cooking chamber, may be achieved.

A particularly high heating efficiency may be achieved, in particular, if the heating unit, in particular at least the adapting element, in at least one non-heated operating state has a minimum first spacing from the cooking chamber element and in the heating operating state a minimum second spacing which is at least substantially equal to the first spacing. Two spacings being "at least substantially equal" is intended to be understood, in particular, as a spacing differing from a spacing, compared with this spacing, by at most 10%, advantageously by at most 5% and particularly preferably by at most 2%. Advantageously, a minimum spacing between the heating unit, in particular at least the adapting element and the cooking chamber element, is in this case at least substantially constant. In a preferred exemplary embodiment, a spacing between the adapting element and the cooking chamber element is at most 5 mm, advantageously at most 3 mm and particularly preferably at most 1 mm. In this connection, by the phrase "at least substantially constant" is intended to be understood, in particular, as a spacing differing from an average spacing above the object by at most 5%, preferably by at most 3% and particularly preferably by at most 2%. In particular, it may be achieved that at least a large proportion of the heat losses are only produced inside the cooking chamber.

The heating element in this case could be configured, for example, as a resistance heating element. Advantageously, however, it is proposed that the heating element is configured as an induction heating element. In particular, the heating element which is configured as an induction heating element is provided to generate an electromagnetic alternating field, in particular at a frequency of between 17 kHz and 150 kHz and advantageously between 20 kHz and 100 kHz and, in particular, by means of the electromagnetic alternating field to generate heat, in particular by eddy-current induction and/or remagnetizing effects in at least one, in particular at least partially metallic, preferably ferromagnetic object to be heated, advantageously the cooking chamber element. As a result, a particularly efficient heating of the cooking chamber element may be advantageously achieved. Advantageously, operating costs may also be reduced.

The adapting element in this case may, in particular, be fully arranged between the heating element and the cooking chamber element, in particular at least when observed parallel to a main extension plane of the heating element and/or the cooking chamber element. In an advantageous embodiment of the invention, however, it is proposed that the heating element is at least partially arranged between the cooking chamber element and the adapting element, in particular at least when observed parallel to a main extension plane of the heating element and/or the cooking chamber element. The "main extension plane" of an object is intended to be understood, in particular, in this case as a plane which is parallel to a largest side surface of a smallest, in particular imaginary, cuboid which completely encloses the object and, in particular, extends through a central point, in particular a geometric central point of the cuboid. As a result, in particular, an advantageous retention of the heating element may be achieved, in particular, by the adapting element.

It is further proposed that the heating element and the adapting element are in contact. "In contact" is intended to be understood in this connection, in particular, as a surface of the heating element and a surface of the adapting element touching one another. In particular, the heating element and the adapting element in this case may be connected together by an adhesively bonded connection and/or advantageously a clamped connection. As a result, in particular, a uniform adaptation of the adapting element and the heating element to the cooking chamber element may be achieved.

In order to achieve a particularly advantageous adaptation of the heating unit to the cooking chamber element, it is proposed that the adapting element is configured to be at least partially flexible. In this connection, a "flexible object" is intended to be understood, in particular, as an object which has at least one part region and/or at least one part which in at least one operating state, advantageously at least in the heating operating state, is able to be changed at least in its position by at least 0.1 mm, preferably by at least 0.5 mm and particularly preferably by at least 1 mm, advantageously effected by a thermal expansion of the flexible object. In particular, the flexible object is repeatedly deformable, in particular without damage. Particularly preferably, in this case the flexible object in a further operating state, advantageously the non-heated operating state, and in particular after a deformation, automatically tends to gain its basic shape and/or returns to its basic shape. Alternatively or additionally, in particular, the heating element and/or the adapting element and/or preferably the heating unit may have a thermal coefficient of expansion which is at least substantially identical to a thermal coefficient of expansion of the cooking chamber element. A "substantially identical" thermal coefficient of expansion is intended to be understood in this connection, in particular, as a thermal coefficient of expansion which differs from a further thermal coefficient of expansion of a further object by at most 20%, advantageously by at most 10% and particularly preferably by at most 5%. In particular, as a result a uniform thermal expansion of the heating unit and the cooking chamber element is achieved, whereby advantageously an adaptation of the heating unit to the cooking chamber element may be improved. As a result, in particular, wear may be reduced and advantageously an adaptation of the heating unit may be improved.

The adapting element could, for example, at least partially and preferably at least largely, consist of a metal, in particular aluminum and/or stainless steel. Advantageously, however, it is proposed that the adapting element at least partially and preferably at least largely consists of an electrically insulating material, in particular plastics and advantageously a phyllosilicate, in particular mica. By the expression "at least largely" is intended to be understood, in particular, in this case as at least 55%, advantageously at least 65%, preferably at least 75%, particularly preferably at least 85% and particularly advantageously at least 95%. As a result, in particular, an advantageous insulating effect may be achieved.

In particular, in order to achieve an advantageous adaptation of the adapting element it is additionally proposed that the adapting element is configured to be at least partially slotted. In this case, the adapting element, in particular, comprises at least one slot which, in particular, at least partially and preferably at least largely extends over a longitudinal extent and/or a transverse extent of the adapting element. The slot in this case may, in particular, have a path which is curved, bent, undulating, oblique and/or advantageously linear. In particular, in this case at least two adapting elements with different, in particular corresponding, slots and/or slot patterns may also be connected together in a planar manner.

Additionally, a method for operating a cooking appliance device is proposed, said cooking appliance device having at least one heating unit, and at least one cooking chamber element which at least partially bounds a cooking chamber, wherein in at least one heating operating state the cooking chamber is heated by means of at least one heating element of the heating unit and a surface shape of at least one part region of the cooking chamber element changes, in the heating operating state, by thermal expansion of the cooking chamber element, wherein in the heating operating state at least one adapting element of the heating unit, which is arranged at least in part on the cooking chamber element, is adapted to the surface shape of the part region. By this embodiment of the cooking appliance device, in particular an efficiency, in particular a heating efficiency, an energy efficiency and/or a cost efficiency, may be improved. In particular, in this case a high heating efficiency may be achieved and power and/or energy costs may be reduced. Additionally, a more even heat distribution in the cooking chamber may be advantageously achieved. In this case, in particular, in the heating operating state an improved heat transmission to the cooking chamber element and/or a more even heat distribution in the cooking chamber may be achieved.

Further advantages are disclosed in the following description of the drawings. Exemplary embodiments of the invention are shown in the drawings. The drawings, the description and the claims contain numerous features in combination. The person skilled in the art will also expediently consider the features individually and combine them together to form further useful combinations.

DETAILED DESCRIPTION OF EXEMPLARY EMBODIMENTS OF THE PRESENT INVENTION

Figure 1:
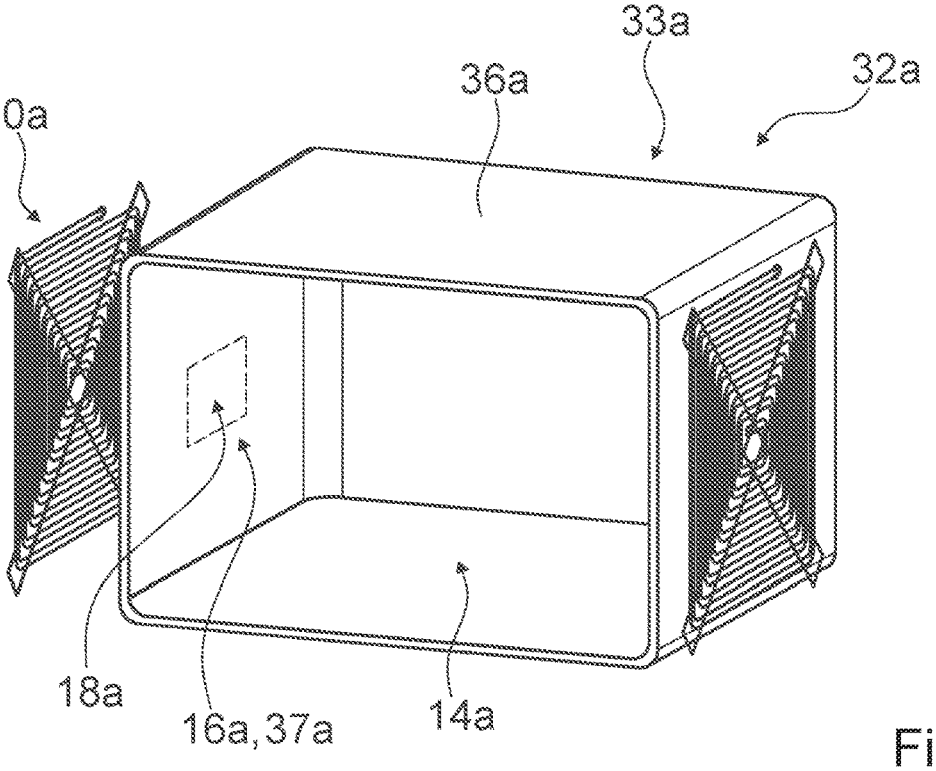
FIG. 1 shows a cooking appliance configured by way of example as an oven with a cooking appliance device comprising a cooking chamber element and a heating unit in a perspective partial view.

FIG. 1 shows a cooking appliance 32*a* in a perspective view. In the present case the cooking appliance 32*a* is configured by way of example as an oven, in the present case in particular as an induction oven. Alternatively, a cooking appliance could also be configured as an induction grill appliance, as a microwave oven or as an induction hob.

The cooking appliance 32*a* comprises a cooking appliance device. The cooking appliance device comprises a cooking appliance housing 33*a*. The cooking appliance housing 33*a* defines a cooking chamber 14*a*. To this end, the cooking appliance housing 33*a* comprises an outer housing (not shown) and a muffle 36*a*, which is arranged inside the outer housing and bounds the cooking chamber 14*a*, having at least one muffle wall 37*a*. Additionally, the muffle 36*a* comprises further muffle walls which for the sake of clarity are not provided with reference numerals. The muffle wall 37*a* is configured as a cooking chamber element 16*a*. Additionally, the further muffle walls are configured as further cooking chamber elements. The cooking chamber element 16*a* comprises at least one part region 18*a*. Additionally, the cooking appliance device comprises an appliance closure element (not shown). The appliance closure element in the present case is configured as a hinged appliance cover. The appliance closure element is provided to close the cooking chamber 14*a*. Alternatively, however, an appliance closure element could also be configured as appliance doors.

Additionally, the cooking appliance device comprises at least one heating unit 10*a*. The heating unit 10*a* is arranged in the vicinity of the cooking chamber 14*a*. The heating unit 10*a* is arranged in the cooking chamber element 16*a*. The heating unit 10*a* is arranged on the part region 18*a* of the cooking chamber element 16*a*. In a heating operating state, the heating unit 10*a* is provided for heating the cooking chamber element 16*a* and, in particular, the part region 18*a*. As a result, in the heating operating state the heating unit 10*a* is at least partially provided for heating the cooking chamber 14*a*. Additionally, the cooking appliance device may comprise further heating units which, however, in the present case have not been assigned reference numerals.

Figure 2:
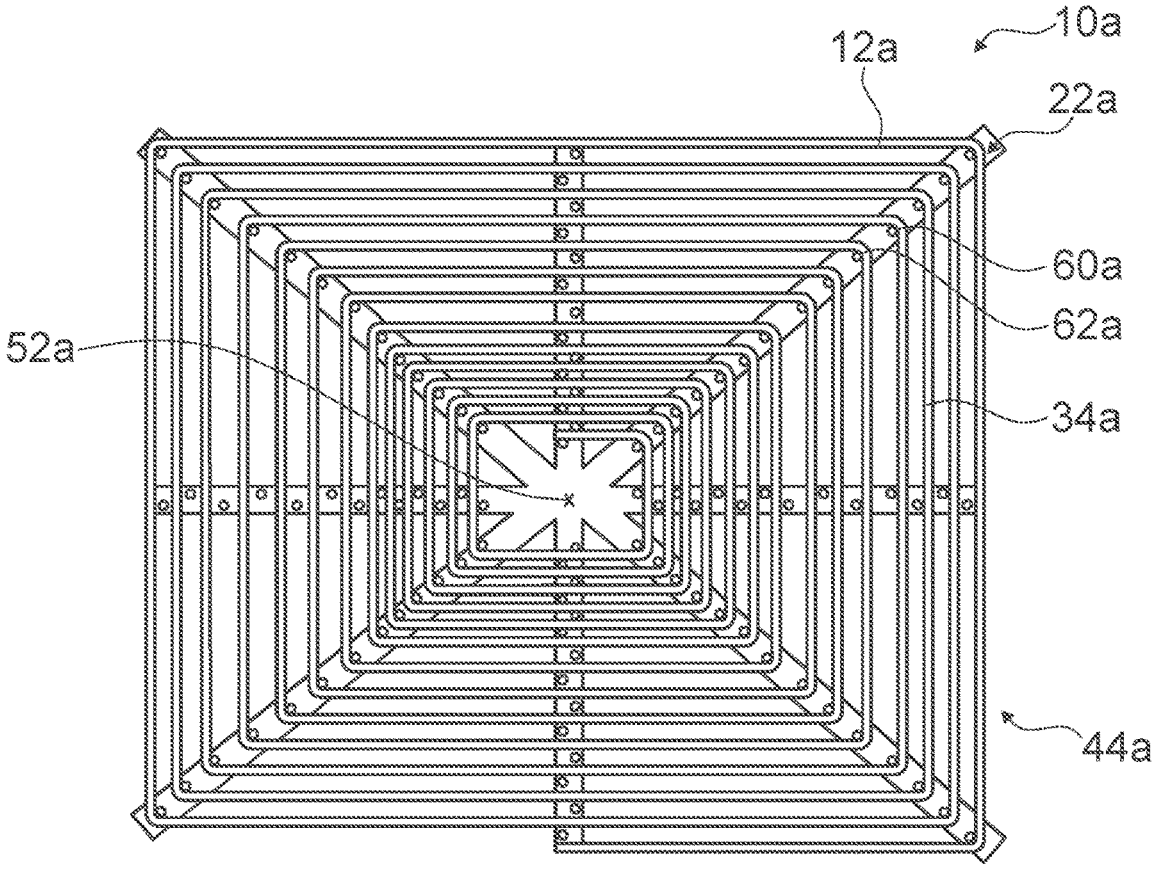
FIG. 2 shows the heating unit in a detailed view.

FIG. 2 shows the heating unit 10*a* in a detailed view. The heating unit 10*a* comprises a heating element 12*a*. The heating element 12*a* is configured as an induction heating element. The heating element 12*a* is configured as a heating coil. The heating element 12*a* is configured from a strip-shaped heating conductor. The heating element 12*a* is of flat configuration. The heating element 12*a* is configured from an individual heating conductor. The heating element 12*a* is configured from copper. The heating element 12*a* comprises at least one winding 34*a*. The heating element 12*a* comprises a plurality of windings 34*a*, in the present case in particular a total of eight windings. Alternatively, a heating element could also be configured as a resistance heating element and/or comprise a number of windings which is different from eight. Moreover, a heating element could alternatively be configured from a plurality of heating conductors and/or a stranded conductor. Alternatively, a heating element could also be configured from a different material and/or without windings.

The heating element 12*a* forms a rectangular shape and/or contour when observed in a plan view. Alternatively, a heating element could have a circular contour, an oval contour and/or a contour of a polygon. The heating element 12*a* has a coil center point 52*a*. Additionally, the heating element 12*a* forms a separate, continuous coil heating region 44*a*.

Additionally, the heating unit 10*a* comprises an adapting element 22*a*. The adapting element 22*a* is configured at least partially from an electrically insulating material. The adapting element 22*a* is formed from a material which is not magnetic, for example from a non-magnetic metal such as from aluminum, from plastics, from ceramics and/or from a phyllosilicate, in particular mica, wherein an adapting element made of mica could preferably have a thickness of approximately 0.3 mm. The adapting element 22*a* is of flexible configuration. The adapting element 22*a* is configured from a flexible material which may be thermally deformed in a reversible manner. The adapting element 22*a* has a thermal coefficient of expansion which is configured to be different from the thermal coefficient of expansion of the heating element 12*a*. The heating unit 10*a* has a thermal coefficient of expansion which is substantially identical to a thermal coefficient of expansion of the cooking chamber element 16*a*. The adapting element 22*a* is of star-shaped configuration. The adapting element 22*a* is integrally configured. The adapting element 22*a* in a mounted state is in contact with the heating element 12*a*. Additionally, the adapting element 22*a* is arranged such that the heating element 12*a* is substantially arranged between the part region 18*a* of the cooking chamber element 16*a* and the adapting element 22*a*. The adapting element 22*a* in this case is arranged radially relative to the coil center point 52*a*. In the heating operating state, the adapting element 22*a* is provided to adapt at least one surface 24*a* facing the part region 18*a* to the surface shape 20*a* of the part region 18*a*. Additionally, the adapting element 22*a* is provided to retain the heating element 12*a*.

To this end, the adapting element 22*a* comprises a plurality of guide bolts 60*a*, 62*a*, wherein in FIG. 2 for the sake of clarity only two of the guide bolts 60*a*, 62*a* are provided with reference numerals. The guide bolts 60*a*, 62*a* are at least substantially identical to one another. The guide bolts 60*a*, 62*a* are arranged so as to be distributed over the adapting element 22*a*. The guide bolts 60*a*, 62*a* are provided for guiding the windings 34*a* of the heating element 12*a*. The guide bolts 60*a*, 62*a* are additionally provided for fixing the windings 34*a* of the heating element 12*a*. To this end, all of the windings 34*a* of the heating element 12*a* are arranged in each case between at least two directly adjacent guide bolts 60*a*, 62*a*. Alternatively, however, an adapting element could also be configured in multiple parts and, for example, comprise a plurality of strip-shaped adapting parts which, for example starting from a coil center point, extend radially outwardly. Additionally, it is conceivable to configure an adapting element as an advantageously rectangular adapting plate. Additionally it is conceivable to configure an adapting element from any other material. It is also conceivable to dispense with guide bolts and/or to use guide elements which are different from guide bolts, such as for example guide hooks.

Figure 3A:
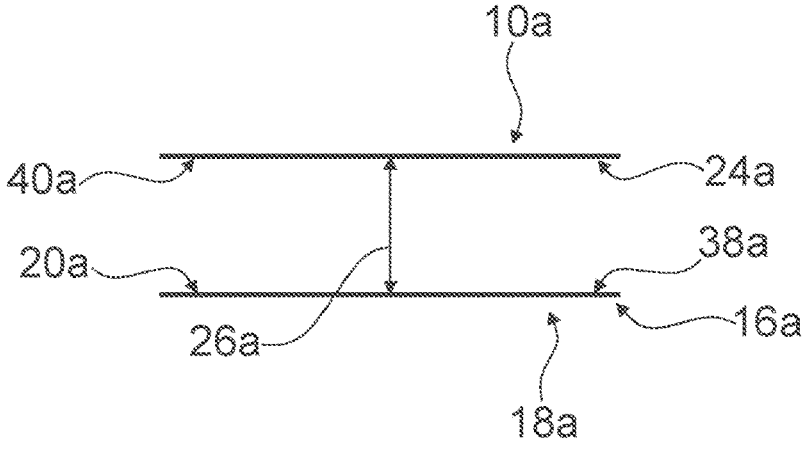
FIG. 3*a* shows the cooking chamber element and the heating unit in a non-heated operating state in a schematic view.

A schematic arrangement of the heating unit 10*a* on the part region 18*a* of the cooking chamber element 16*a* in a non-heated operating state is shown in FIG. 3*a*. The part region 18*a* forms a surface 38*a*. The surface 38*a* of the part region 18*a* has a planar, in particular a flat, surface shape 20*a*. Moreover, the heating unit 10*a*, in particular the adapting element 22*a*, has a surface 24*a* facing the part region 18*a*. In the present case, the adapting element 22*a* together with the heating element 12*a* forms the surface 24*a*. The surface 24*a* of the heating unit 10*a* facing the part region 18*a* forms a further flat surface shape 40*a*. The surface 38*a* of the part region 18*a* and the surface 24*a* of the heating unit 10*a* are arranged parallel to one another. The surface 24*a* of the heating unit 10*a* in the non-heated operating state has a minimum first spacing 26*a* from the surface 38*a* of the part region 18*a*. The heating unit 10*a* in the non-heated operating state has a minimum first spacing 26*a* from the cooking chamber element 16*a*. The minimum first spacing 26*a* of the heating unit 10*a* from the cooking chamber element 16*a* is substantially constant over the entire surface 38*a* of the part region 18*a* and advantageously is at most 1 mm.

Figure 3B:
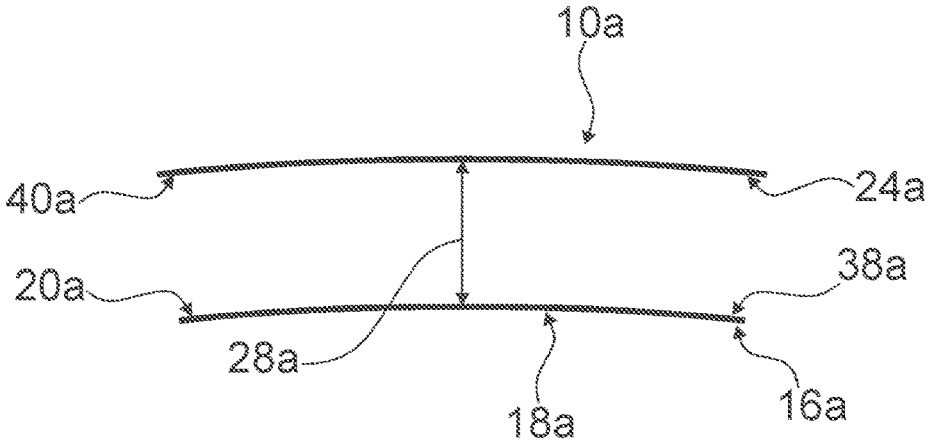
FIG. 3*b* shows the cooking chamber element and the heating unit in a heating operating state in a schematic view.
Figure 4:
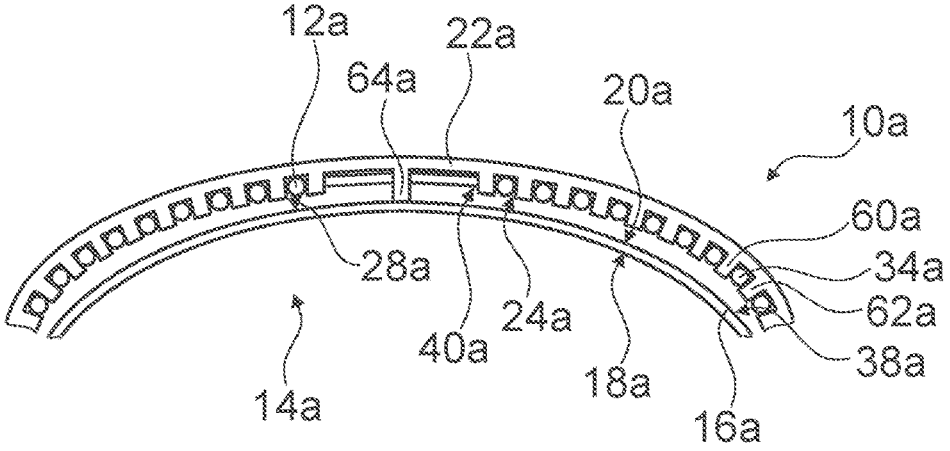
FIG. 4 shows the cooking chamber element and the heating unit in the heating operating state in a detailed view.

A schematic arrangement is shown in FIG. 3*b* and a detailed arrangement is shown in FIG. 4 of the heating unit 10*a* on the part region 18*a* of the cooking chamber element 16*a* in the heating operating state. The heating element 12*a* is arranged between the cooking chamber element 16*a* and the adapting element 22*a*. The windings 34*a* of the heating element 12*a* are arranged between the guide bolts 60*a*, 62*a*. The heating unit 10*a*, in particular the adapting element 22*a*, further comprises a projection 64*a* which spaces the adapting element 22*a* apart from the cooking chamber element 16*a*. The projection 64*a* forms in this case an electrically insulating connection with the cooking chamber element 16*a*. Alternatively, however, a connection of an adapting element to the cooking chamber element may be dispensed with and/or a simple mechanical separation of the heating unit may be achieved.

The part region 18*a* of the cooking chamber element 16*a* expands in the heating operating state due to a heating of the cooking chamber 14*a*. In this case, the surface shape 20*a* of the part region 18*a* changes due to the thermal expansion of the cooking chamber element 16*a*. The surface 38*a* of the part region 18*a* has a curved surface shape 20*a* in the heating operating state. Surfaces may form curvatures of up to 18 mm in a heating operating state at 500° C.

In this case, the adapting element 22*a* is provided to adapt the surface 24*a* facing the part region 18*a* of the cooking chamber element 16*a* to the changed surface shape 20*a* of the part region 18*a*. In this case, the surface 24*a* of the heating unit 10*a* facing the part region 18*a* forms a curved surface shape 40*a* corresponding to the surface shape 20*a*. The surface shape 40*a* of the heating unit 10*a* is complementary to the surface shape 20*a* of the part region 18*a* of the cooking chamber element 16*a*. The surface 38*a* of the part region 18*a* and the surface 24*a* of the heating unit 10*a* are arranged parallel to one another in the heating operating state. In the heating operating state, the surface 24*a* of the heating unit 10*a* has a minimum second spacing 28*a* from the surface 38*a* of the part region 18*a*. In the heating operating state, the heating unit 10*a* has a minimum second spacing 28*a* from the cooking chamber element 16*a*. The minimum second spacing 28*a* in a heating operating state and the minimum first spacing 26*a* in the non-heated operating state are substantially of the same size.

Further exemplary embodiments of the invention are shown in FIGS. 5 to 9. The following descriptions and the drawings are substantially limited to the differences between the exemplary embodiments, wherein relative to components which are denoted the same, in particular with reference to components with the same reference numerals, in principle reference may also be made to the drawings and/or the description of the other exemplary embodiments, in particular FIGS. 1 to 4. For differentiating between the exemplary embodiments, the letter a is placed after the reference numerals of the exemplary embodiment in FIGS. 1 to 4. In the exemplary embodiments of FIGS. 5 to 9, the letter a is replaced by the letters b to d.

Figure 5:
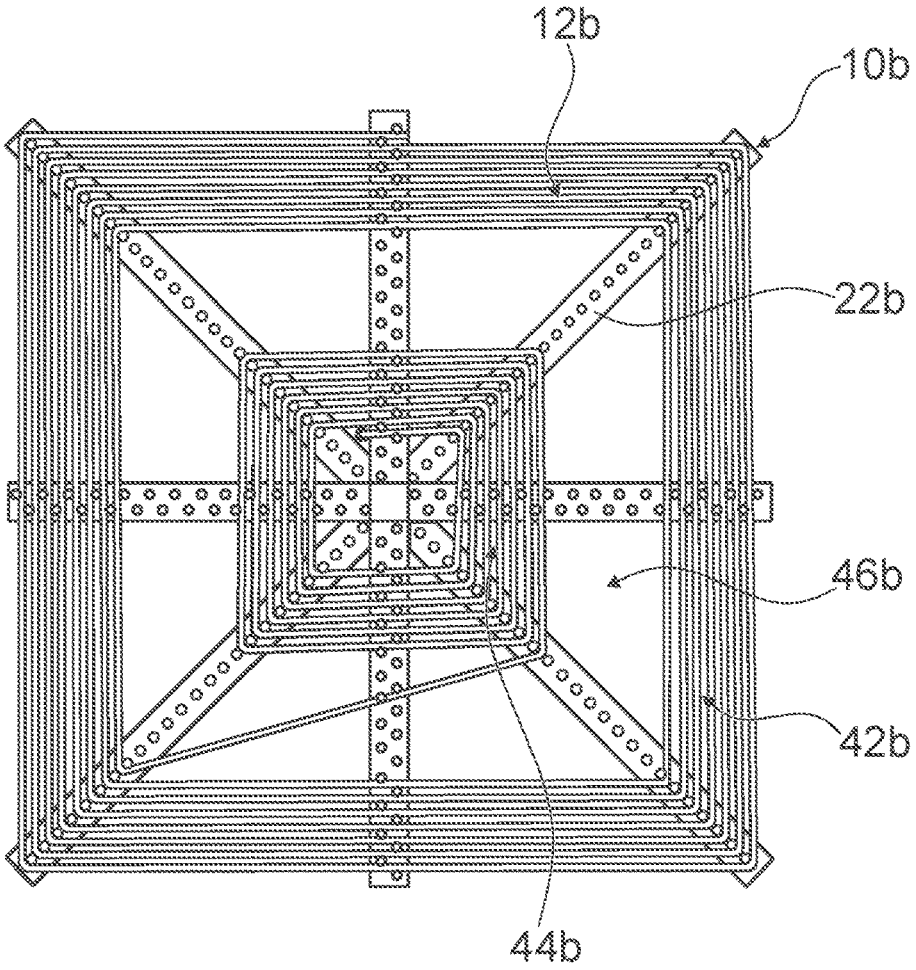
FIG. 5 shows a further exemplary embodiment of a cooking appliance device with a heating unit in a detailed view.

In FIG. 5 a further exemplary embodiment of the invention is shown. The letter b is placed after the reference numerals of the exemplary embodiment. The further exemplary embodiment of FIG. 5 differs at least substantially from the previous exemplary embodiment by a number of coil heating regions 42*b*, 44*b* of a heating element 12*b* of a heating unit 10*b*.

The heating element 12*b* has in the present case two coil heating regions 42*b*, 44*b*, in particular an outer coil heating region 42*b* and an inner coil heating region 44*b*. The outer coil heating region 42*b* and the inner coil heating region 44*b* are separated from one another by a further coil region 46*b*. The further coil region 46*b* in this case has no windings, such that in a heating operating state no heating is carried out. As an alternative to the embodiment, heating units with different numbers of coil heating regions are conceivable.

Figure 6:
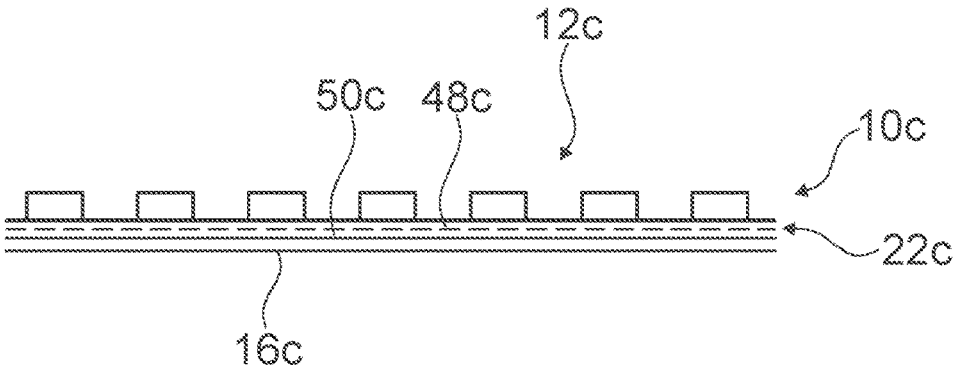
FIG. 6 shows a further exemplary embodiment of a cooking appliance device with a cooking chamber element and a heating unit in a schematic view.

In FIG. 6 a further exemplary embodiment of the invention is shown. The letter c is placed after the reference numerals of the exemplary embodiment. The further exemplary embodiment of FIG. 6 differs at least substantially from the previous exemplary embodiment by an embodiment of an adapting element 22*c* of a heating unit 10*c*.

In the present case, an adapting element 22*c* is configured from a phyllosilicate, in particular mica and by way of example comprises two adapting parts 48*c*, 50*c*. Alternatively, however, an adapting element could also be configured integrally and/or comprise at least three adapting parts. The adapting parts 48*c*, 50*c* are arranged above one another in a mounted state. In the present case the adapting parts 48*c*, 50*c* are connected together non-positively and/or positively. The adapting parts 48*c*, 50*c* are arranged between a heating element 12*c* and a cooking chamber element 16*c*. The adapting parts 48*c*, 50*c* in this case are in direct contact with the heating element 12*c* and the cooking chamber element 16*c*. The adapting parts 48*c*, 50*c* are configured to be electrically insulating. The adapting parts 48*c*, 50*c* are configured as substantially flat disks. The adapting parts 48*c*, 50*c* have a substantially rectangular contour. Additionally, the adapting parts 48*c*, 50*c* are configured to be slotted. Alternatively, the adapting parts could also be configured from a different material. It is also conceivable to connect together the adapting parts by a material connection, by an adhesively bonded and/or fused connection.

Figure 7A:
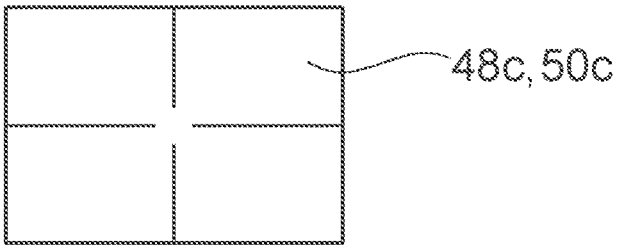
FIGS. 7*a-d* show different embodiments of adapting parts for producing an adapting element of the heating unit of FIG. 6, FIGS. 8*a-d* show different adapting elements from the adapting parts of FIGS. 7*a-d

FIG. 7*a* shows a possible embodiment of the adapting parts 48*c*, 50*c*. The adapting parts 48*c*, 50*c* have radial incisions. The incisions of the adapting parts 48*c*, 50*c* are identified as black lines. The adapting parts 48*c*, 50*c* in this case have a slotted pattern which is formed by incisions along the median line, starting from all four sides.

Figure 7B:
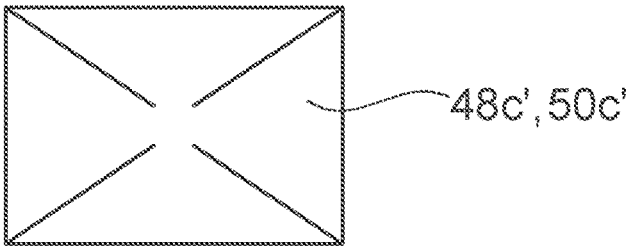
Figure 7C:
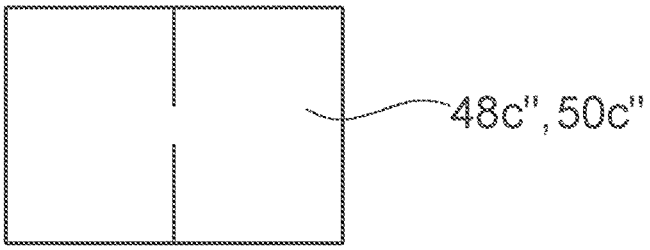
Figure 7D:
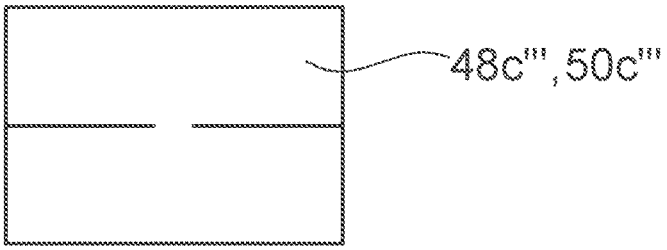
Figure 8A:
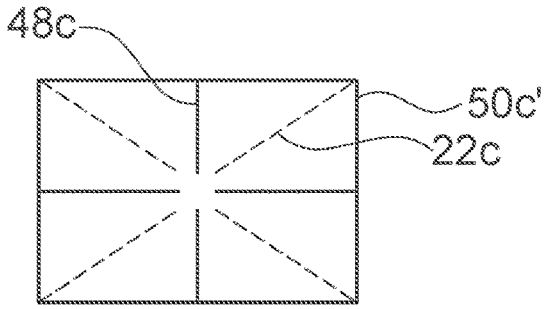
Figure 8B:
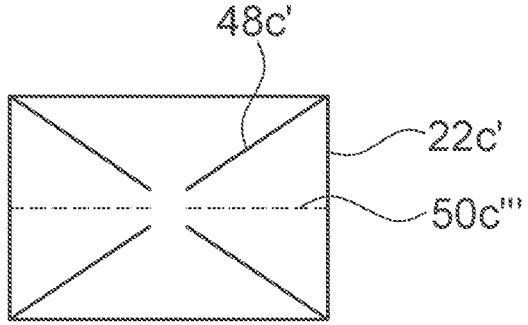
Figure 8C:
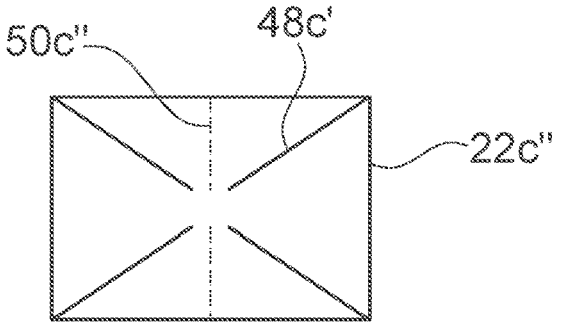
Figure 8D:
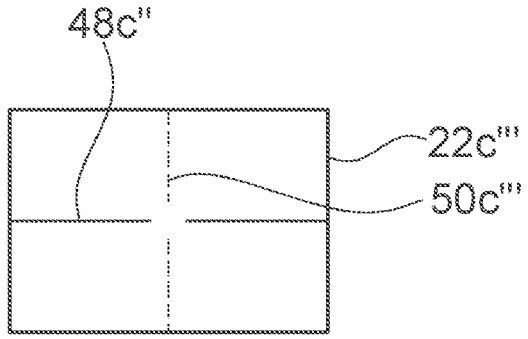

FIGS. 7*b* to 7*d* show three further possible embodiments of the adapting parts which are identified by the letters c', c", c'" for differentiation.

In FIG. 7*b* a slotted pattern of diagonal slots is formed, starting from four corners. In FIG. 7*c* a slotted pattern corresponds to slots along the median line, starting from two long rectangular sides. In FIG. 7*d* a slotted pattern corresponds to slots along the median line, starting from the short rectangular sides.

Different adapting elements 22*c*, 22*c*', 22*c*", 22*c*'", which are produced from the adapting parts 48*c*, 48*c*', 48*c*", 48*c*'", 50*c*, 50*c*', 50*c*", 50*c*'" shown in FIGS. 7*a* to 7*d*, are shown in FIGS. 8*a* to 8*d*.

Figure 9:
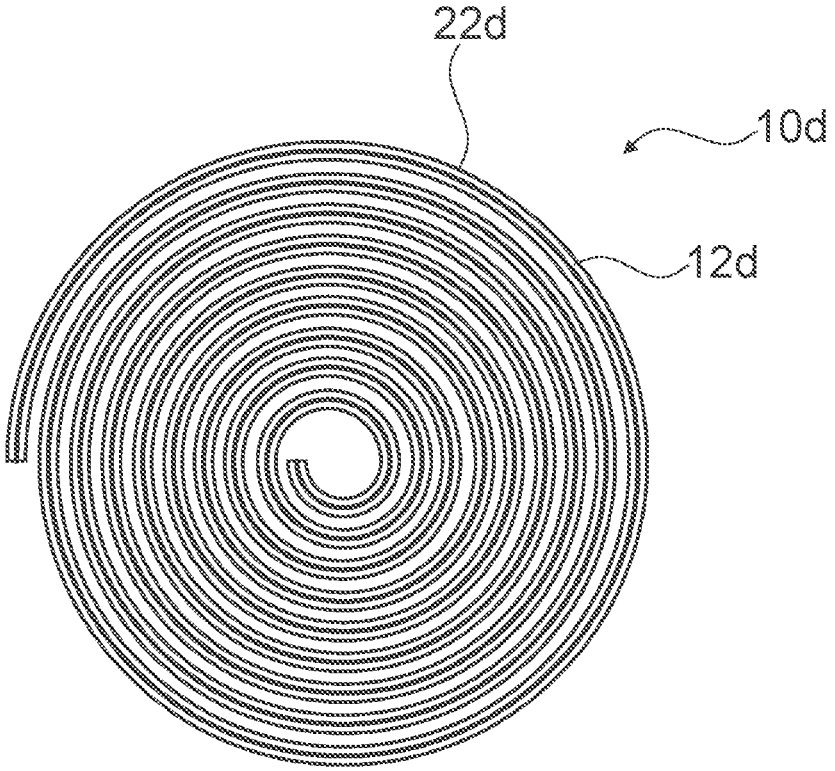
* and FIG. 9 shows a further exemplary embodiment of a cooking appliance device with a heating unit in a detailed view.

In FIG. 9 a further exemplary embodiment of the invention is shown. The letter d is placed after the reference numerals of the exemplary embodiment. The further exemplary embodiment of FIG. 9 differs at least substantially from the previous exemplary embodiment by an embodiment of an adapting element 22*d* and/or a heating element 12*d* of a heating unit 10*d*.

In this case, a shape and/or contour of the heating element 12*d* and the adapting element 22*d* are at least substantially identical. The heating element 12*d* has a spiral-shaped contour. The adapting element 22*d* has a spiral-shaped contour. The heating element 12*d* and the adapting element 22*d* have accordingly the same contour.

The invention claimed is:

1. A cooking appliance device, comprising:

a heating unit including a heating element for heating a cooking chamber in a heating operating state; and a cooking chamber element configured to at least partially bound the cooking chamber and having a part region with a surface shape which changes in the heating operating state in response to a thermal expansion of the cooking chamber element, said heating unit including an adapting element arranged at least in part on the cooking chamber element and having in facing relation to the part region a surface which adapts in the heating operating state to the surface shape of the part region, wherein the adapting element comprises a flat portion and a plurality of guide protrusions extending from one side of the flat portion, the entire heating element is located on the one side of the flat portion, and the guide protrusions extend between windings of the heating element, and the entire heating element is located between the flat portion and the cooking chamber element.

2. The cooking appliance device of claim 1, wherein the heating unit has a minimum first spacing from the cooking chamber element in a non-heated operating state of the heating element, said heating unit having in the heating operating state a minimum second spacing from the cooking chamber element, wherein the minimum second spacing differs at most by 10% from the minimum first spacing.

3. The cooking appliance device of claim 1, wherein the heating element is configured as an induction heating element.

4. The cooking appliance device of claim 1, wherein the heating element and the adapting element are in contact.

5. The cooking appliance device of claim 1, wherein the adapting element is configured to be at least partially flexible.

6. The cooking appliance device of claim 1, wherein the adapting element is made at least partially of an electrically insulating material.

7. The cooking appliance device of claim 1, wherein the adapting element is configured to be slotted.

8. The cooking appliance of claim 1, wherein the flat portion has a plurality of legs extending from a center point, and the guide protrusions are located on the legs.

9. The cooking appliance of claim 1, wherein each of the windings is separated from an adjacent one of the windings by one of the guide protrusions.

10. A cooking appliance, comprising a cooking appliance device, said cooking appliance device comprising a heating unit including a heating element for heating a cooking chamber in a heating operating state, and a cooking chamber element configured to at least partially bound the cooking chamber and having a part region with a surface shape which changes in the heating operating state in response to a thermal expansion of the cooking chamber element, said heating unit including an adapting element arranged at least in part on the cooking chamber element and having in facing relation to the part region a surface which adapts in the heating operating state to the surface shape of the part region, wherein the adapting element comprises a flat portion and a plurality of guide protrusions extending from one side of the flat portion, the entire heating element is located on the one side of the flat portion, and the guide protrusions extend between windings of the heating element, and the entire heating element is located between the flat portion and the cooking chamber element.

11. The cooking appliance of claim 10, wherein the heating unit has a minimum first spacing from the cooking chamber element in a non-heated operating state of the heating element, said heating unit having in the heating operating state a minimum second spacing from the cooking chamber element, wherein the minimum second spacing differs at most by 5% from the minimum first spacing.

12. The cooking appliance of claim 10, wherein the heating element is configured as an induction heating element.

13. The cooking appliance of claim 10, wherein the heating element and the adapting element are in contact.

14. The cooking appliance of claim 10, wherein the adapting element is configured to be at least partially flexible.

15. The cooking appliance of claim 10, wherein the adapting element is made at least partially of an electrically insulating material.

16. The cooking appliance of claim 10, wherein the adapting element is configured to be slotted.

17. The cooking appliance of claim 10, wherein the flat portion has a plurality of legs extending from a center point, and the guide protrusions are located on the legs.

18. A method for operating a cooking appliance device, said method comprising:

heating in a heating operating state a cooking chamber of the cooking appliance device by a heating element of a heating unit, thereby changing a surface shape of a part region of a cooking chamber element that at least partially bounds the cooking chamber in response to a thermal expansion of the cooking chamber element; and adapting in the heating operating state an adapting element of the heating unit, arranged at least in part on the cooking chamber element, to the surface shape of the part region, wherein the adapting element comprises a flat portion and a plurality of guide protrusions extending from one side of the flat portion, the entire heating element is located on the one side of the flat portion, and the guide protrusions extend between windings of the heating element, and the entire heating element is located between the flat portion and the cooking chamber element.

19. The method of claim 18, wherein the heating element and the adapting element are in contact.

20. The method of claim 18, wherein the flat portion has a plurality of legs extending from a center point, and the guide protrusions are located on the legs.

* * * * *